US008188678B2

(12) United States Patent
Siessegger

(10) Patent No.: US 8,188,678 B2
(45) Date of Patent: May 29, 2012

(54) CIRCUIT ARRANGEMENT FOR OPERATING AT LEAST ONE SEMICONDUCTOR LIGHT SOURCE

(75) Inventor: Bernhard Siessegger, Munich (DE)

(73) Assignee: Osram AG, München (DE)

( * ) Notice: Subject to any disclaimer, the term of this patent is extended or adjusted under 35 U.S.C. 154(b) by 472 days.

(21) Appl. No.: 12/546,359

(22) Filed: Aug. 24, 2009

(65) Prior Publication Data

US 2010/0045208 A1 Feb. 25, 2010

(30) Foreign Application Priority Data

Aug. 22, 2008 (DE) ..... 10 2008 039 351

(51) Int. Cl.
*H05B 37/02* (2006.01)

(52) U.S. Cl. ..... 315/294; 315/297; 315/308

(58) Field of Classification Search ..... 315/291, 315/294–295, 297, 307–308
See application file for complete search history.

(56) References Cited

U.S. PATENT DOCUMENTS 4,198,650 A * 4/1980 Hongu et al. ..... 348/613
4,491,903 A * 1/1985 Montague ..... 363/48
6,040,663 A 3/2000 Bucks et al.
6,856,101 B1 * 2/2005 Hitchcock ..... 315/227 R
6,989,807 B2 * 1/2006 Chiang ..... 345/82

FOREIGN PATENT DOCUMENTS

DE 100 13 207 9/2001
EP 0 948 241 3/1999

OTHER PUBLICATIONS

B. Andreycak, "Zero Voltage Switching Resonant Power Conversion", Unitrode Switching Regulated Power Supply Design Seminar Manual, pp. 1-1 to 1-14, Unitrode Corporation 1990.

* cited by examiner

*Primary Examiner* — Jason M Crawford
(74) *Attorney, Agent, or Firm* — Cozen O'Connor

(57) ABSTRACT

A circuit arrangement for operating at least one semiconductor light source having an input for inputting an input voltage, an output for outputting an output voltage to the semiconductor light source, wherein the main current path of the circuit arrangement lies between the two input terminals, and comprises a series circuit formed by a switch, an inductance and a back-to-back connection of a first diode or light emitting diode and the at least one semiconductor light source, wherein a first storage capacitor is arranged in parallel with the at least one semiconductor light source, and a second diode is arranged in series with this parallel connection.

14 Claims, 5 Drawing Sheets

CIRCUIT ARRANGEMENT FOR OPERATING AT LEAST ONE SEMICONDUCTOR LIGHT SOURCE

FIELD OF THE INVENTION

The invention relates to a circuit arrangement for operating at least one semiconductor light source having an input for inputting an input voltage, an output for outputting an output voltage to the semiconductor light source, wherein the input voltage is greater than the output voltage.

BACKGROUND OF THE INVENTION

EP 0 948 241 A2 discloses a circuit arrangement for operating light emitting diodes, which has an input for inputting an input voltage and an output for outputting to the light emitting diodes. In the case of the circuit disclosed therein, the series-connected LEDs are connected in series with the inductor N1, which is in turn connected in series with a switch K1, and are connected to the voltage supply. The switch K1 is opened when a predetermined upper threshold value, i.e. a predetermined switch current, is reached. This mode of operation is known to the person skilled in the art as current mode control, on the basis of the signal of the shunt R2. In the subsequent demagnetization phase, the inductor current freewheels via the diode connected back-to-back with respect to the light emitting diodes and the inductor. If the freewheeling current reaches a predetermined lower threshold value, the switch K1 is closed again and the inductor is magnetized anew. One prerequisite for the function described is that the input voltage $U_{in}$ is always greater than the forward voltage of the light emitting diodes.

In EP 0 948 241 A2, the inductor N1 is embodied as a winding of a transformer, with the result that an auxiliary voltage supply can be realized by means of the winding N2 and also D2 and C2. The circuit is started up via the R1 directly by the input voltage $U_{in}$. The auxiliary winding N2 has a further task: via said auxiliary winding, the freewheeling current is measured indirectly by means of the circuit part C, which supplies a control signal for switching the switch K1 on again. If the inductor is demagnetized, the voltage at the winding N2 jumps, which is detected by the circuit part C. The transformer can be embodied as a three-winding transformer, wherein the third winding N3 together with the circuit part B realizes an additional synchronous rectification with respect to the diode D1.

The circuit arrangement has the major disadvantage, however, that the switch K1 is generally subjected to hard switching, that is to say that ZVS (zero voltage switching) is not implemented; in the case of ZVS, the circuit is operated in such a way that the corresponding switch is switched whenever the voltage across the switch is substantially zero. This is not the case in the circuit arrangement according to EP 0 948 241 A2; in particular in the case of a non-intermittent, i.e. constant, current through the light emitting diodes, the reverse recovery effect of the diode D1 leads to a significant reduction of the efficiency of the circuit, which, in particular in the case of a rising switching frequency—necessary for miniaturization—leads to a decreasing efficiency owing to rising switching losses.

The article "Zero Voltage Switching Resonant Power Conversion", printed in the seminar manual "Switching Regulated Power Supply Design" from Unitrode Corporation, published in 1990, discloses a circuit arrangement in accordance with FIG. 2, having an input for inputting an input voltage and an output for outputting an output voltage to a load. This circuit arrangement operates with ZVS; consequently, the switching losses are minimized. If one or a plurality of series-connected light emitting diodes are connected to this circuit arrangement, then said diodes are fundamentally operated in pulsed fashion since a pulsating DC voltage is applied to the load, and, contrary to the illustration in FIG. 2 of the article, the load does not approximately behave like a current source (designated as $I_{OUT}$ in the article). The light emitting diodes are turned on in one half-cycle; the diode $D_0$ is turned on in the other half-cycle. However, the pulsed mode of operation is not optimum for a good efficiency of the light emitting diodes. Moreover, the optical appearance of the light emission can be impaired in the case of pulsed operation.

SUMMARY OF THE INVENTION

It is an object of the invention to specify a circuit arrangement for operating at least one semiconductor light source having an input for inputting an input voltage, and an output for outputting an output voltage to the semiconductor light source, wherein the circuit arrangement has a better efficiency as a result of a continuous mode of operation of the light emitting diodes.

The object is achieved according to one aspect of the invention by means of a circuit arrangement for operating at least one semiconductor light source having an input for inputting an input voltage, an output for outputting an output voltage to the semiconductor light source, wherein the main current path of the circuit arrangement lies between the two input terminals, and comprises a series circuit formed by a switch, an inductance and a back-to-back connection of a first diode and the at least one semiconductor light source, wherein a first storage capacitor is arranged in parallel with the at least one semiconductor light source, and a second diode is arranged in series with this parallel connection.

In one preferred embodiment, a resonance capacitor is arranged in parallel with the switch, the capacitance of said resonance capacitor being greater than the effectively active parasitic capacitance of the switch.

The effectively active parasitic capacitance of the switch should be considered to be the capacitance which results from the small signal capacitance of the switch given a nominal input voltage and with the switch turned off. In the case of a MOSFET, for example, this is the output capacitance that results in the case of a gate-source voltage of 0 V, this capacitance often being designated by $C_{oss}$ in data sheets.

The circuit is particularly suitable for a configuration in which the input voltage is greater than the output voltage. In order to utilize the advantages of the circuit arrangement according to the invention particularly well, the switch (Q1) for operating the at least one semiconductor light source (D1) is preferably clocked with a high frequency.

In this case, the clock frequency of the switch can be greater than 80 kHz, particularly preferably greater than 500 kHz. This is possible without a significant increase in the power loss since the switch is operated in the ZVS mode. In this mode of operation, the transistor is always switched on or off at a voltage that is substantially zero. In this case, the switch is preferably operated with a constant switch-off time and a variable switch-on time.

On account of the measures preferably present for reducing the maximum rate of voltage change across the diode or diodes, so-called soft switching, the high clock frequency of the switch does not lead to appreciable switching losses in the diode or diodes, as might be expected at these high switching frequencies.

If a plurality of semiconductor light sources are operated by the circuit arrangement, then they are preferably connected up in series.

In order to prevent interference currents into the voltage supply and to improve the electromagnetic compatibility, a second storage capacitor is preferably arranged in parallel with the main current path. In order to be able to measure the energy conversion of the circuit arrangement, preferably a current measuring resistor is additionally arranged in series with the main current path. In this case, one pole of the current measuring resistor is preferably connected to ground, and the other pole of the current measuring resistor is connected to one pole of the first storage capacitor and to one pole of the switch.

In a first preferred embodiment, the at least one semiconductor light source is operated in clocked fashion. In a second embodiment according to the invention, a first storage capacitor is arranged in parallel with the at least one semiconductor light source, and a second diode is arranged in series with this parallel connection. This extension of the circuit arrangement advantageously has the effect that the at least one semiconductor light source is operated continuously. In this case, the power emitted to the at least one semiconductor light source is preferably set by means of the frequency. As a result of this measure, the control circuit required for power regulation becomes simple and compact. Particularly preferably, in this case, the power emitted to the at least one semiconductor light source is higher at relatively low frequency and lower at relatively high frequency.

BRIEF DESCRIPTION OF THE DRAWINGS

Further advantages, features and details of the invention are evident on the basis of the following description of exemplary embodiments and also on the basis of the drawings, in which identical or functionally identical elements are provided with identical reference symbols. In this case.

DETAILED DESCRIPTION OF THE DRAWINGS

First Embodiment

The mode of operation of the circuit arrangement according to the invention is explained below with reference to FIGS. 1*a-d* and FIG. 2. Operation of the circuit arrangement in progress can be subdivided into four phases. The current flow in the circuit arrangement in the different phases is in each case indicated by arrows.

The main current path of the circuit arrangement according to the invention comprises a series circuit formed by a current measuring resistor $R_{shunt}$, a power MOS field effect transistor Q1, an inductance L and a back-to-back connection of a diode and at least one light emitting diode. The branch back-to-back with respect to the diode can, however, also comprise a series circuit formed by a plurality of light emitting diodes, as indicated on the right in FIG. 1*a*. A storage capacitor C2 is connected in parallel with the series circuit formed by the transistor Q1, the inductance L and the back-to-back connection of the diode and the at least one light emitting diode. A resonance capacitor C1 is connected in parallel with the switch Q1. The main current path is connected to an input voltage $V_{in}$.

Figure 1A:
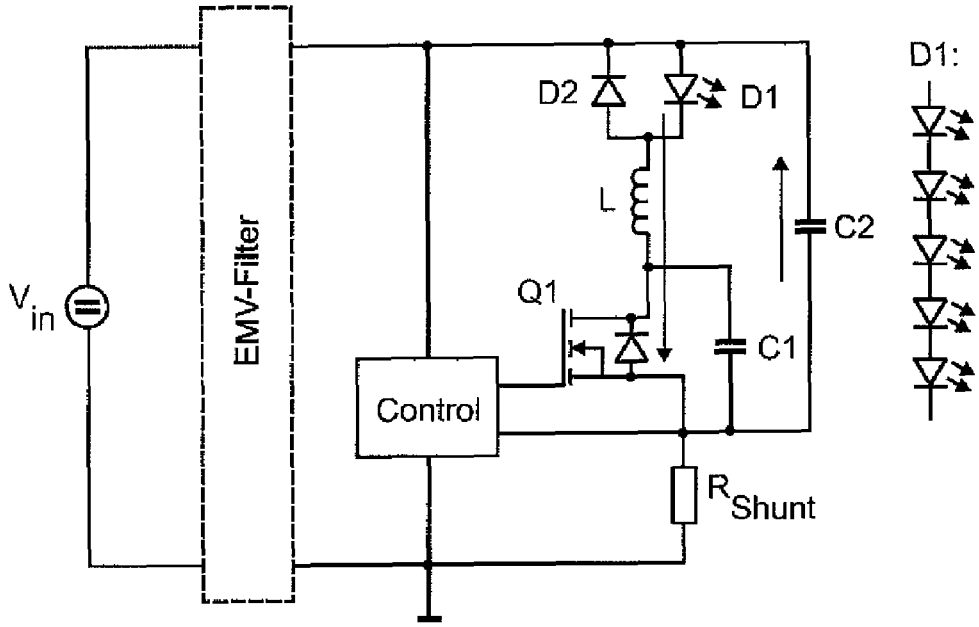
FIGS. 1*a-d* show a simplified circuit diagram of a circuit arrangement according to the invention in a first embodiment with consideration of the different operating phases.
Figure 2:
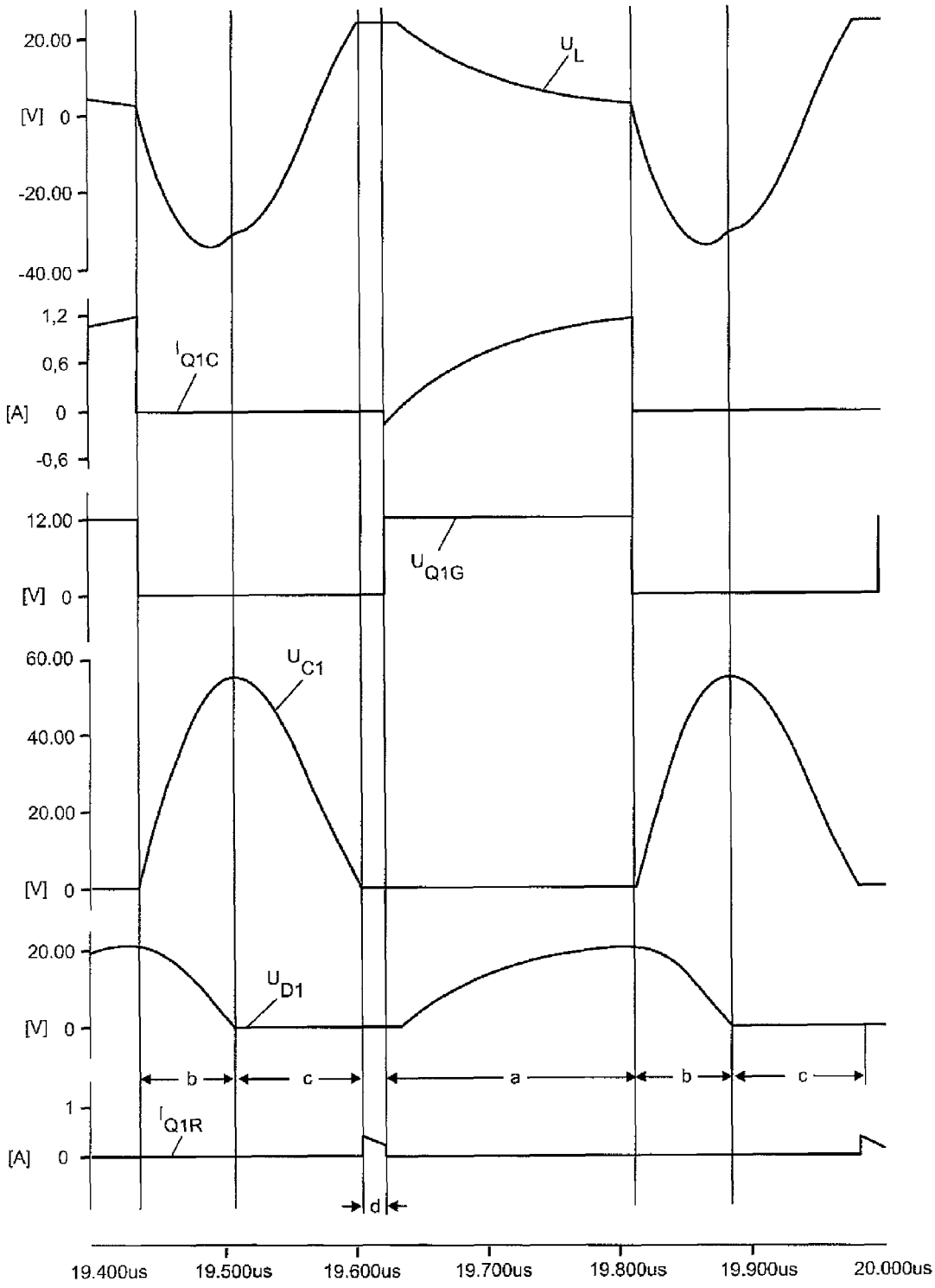
FIG. 2 shows some signals from the circuit arrangement from FIG. 1.

In the first phase a, which is shown in FIG. 1*a*, the switch Q1 is closed. A current flows from the storage capacitor C2 through the at least one light emitting diode D1 and the inductance L. Since the input voltage $V_{in}$ is greater than the forward voltage of the at least one light emitting diode D1, the corresponding voltage difference is dropped across the inductance L. The voltage $U_L$ across the inductance L corresponds to a rise in the current. As can be seen in FIG. 2, the current $I_{Q1C}$ through the transistor and the voltage $U_{D1}$ across the light emitting diode rise in the case of the dimensioning in accordance with the first exemplary embodiment. At the end of the phase a, the transistor Q1 is switched off, as can be discerned from the gate voltage $U_{Q1G}$.

Figure 1B:
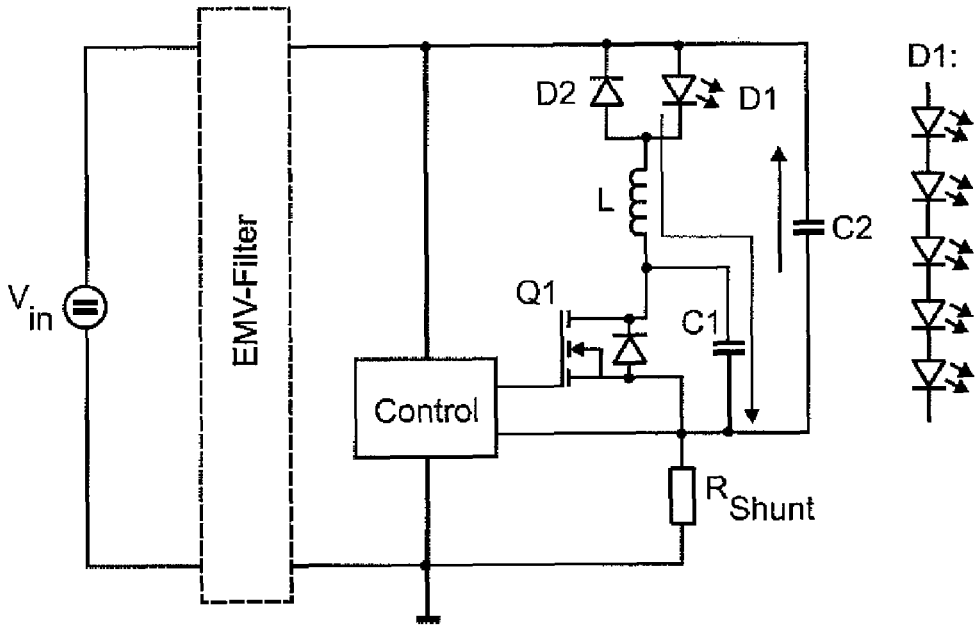

In phase b, which is shown in FIG. 1*b*, the current through the inductance L and the voltage across the storage capacitor C2 continue to be driven and charge the resonance capacitor C1. The voltage $U_{C1}$ across the resonance capacitor rises. The light emitting diode also continues to be operated, but the voltage $U_{D1}$ across the light emitting diode falls. The current through the inductance L then decreases, but continues to flow in the positive direction until the entire energy stored in L has been emitted to C1 and D1. At some point in time the current through the inductance L becomes zero. At this point in time—presupposing correct dimensioning—the resonance capacitor C1 has, however, a higher voltage than the voltage across the storage capacitor C2, which is charged to the input voltage $V_{in}$, and the diode D2 starts to conduct.

Figure 1C:
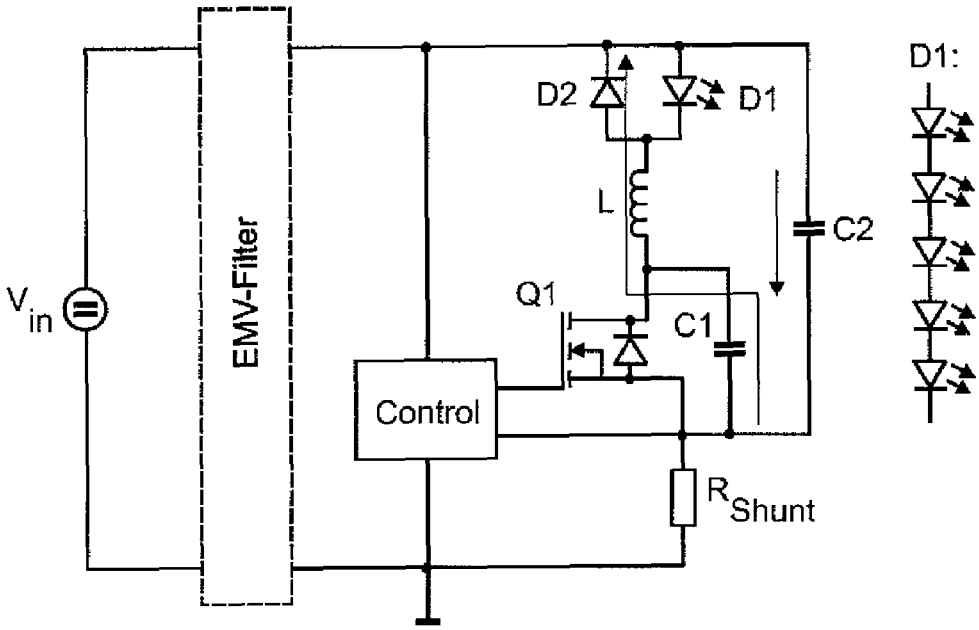
Figure 1D:
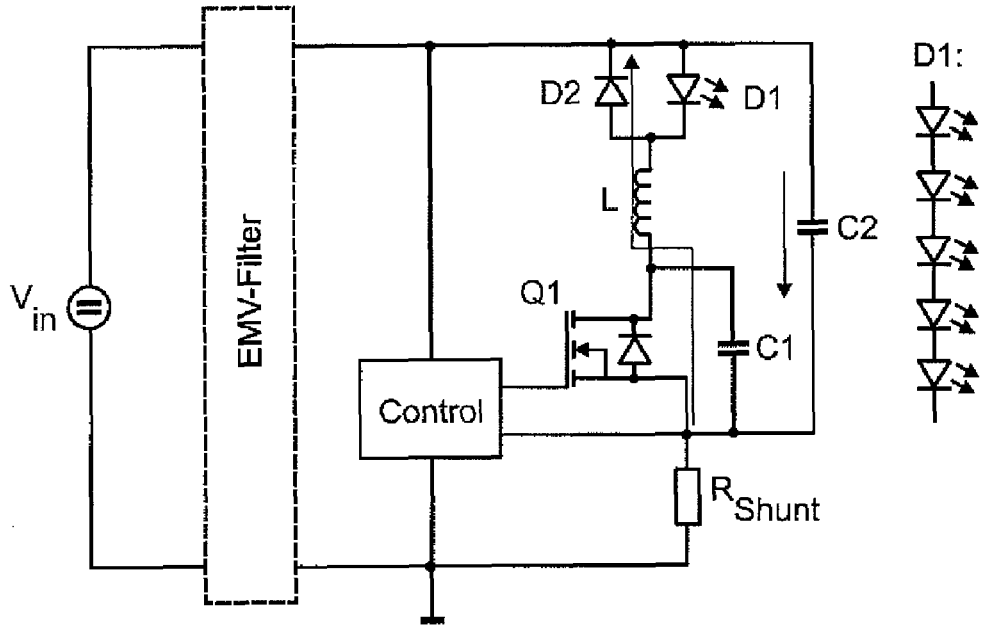

The "changeover in oscillation polarity" occurs, and operation undergoes transition to phase c, which is illustrated in FIG. 1*c*: the resonance capacitor C1 now drives a current through the diode D2, the inductance L and the storage capacitor C2. The voltage across the resonance capacitor C1 thus falls. The current through the inductance L now flows in the opposite direction to before. The current through the inductance L rises until the voltages of the resonance capacitor C1 and the storage capacitor C2 are equal in magnitude. Starting from this instant, the current through the inductance L decreases since the inductance L then discharges the resonance capacitor C1 below the input voltage. The voltage of the resonance capacitor C1 decreases further, to be precise until it reaches zero and then becomes negative. However, the capacitor voltage does not become appreciably negative since the body diode of the transistor Q1 now starts to conduct in phase d, which is illustrated in FIG. 1*d*. As long as there is still energy stored in the inductance L, the body diode conducts and energy is transferred from the inductance L into the storage capacitor C2. During this process, the transistor can be switched on again. The driving of the gate brings about a partial or—as illustrated in FIG. 2—complete acceptance of the current of the body diode $I_{Q1R}$ by the channel of the transistor $I_{Q1C}$ and ultimately the process described above begins again with phase a.

This mode of operation ensures so-called ZVS operation (zero voltage switching), in which the transistor is always switched on or off at a voltage that is substantially zero. Directly before the transistor Q1 is switched on, its body diode (or a diode which is connected back-to-back with respect to the transistor and which is absolutely necessary particularly when a bipolar transistor is used) is in the on state, with the result that approximately no voltage is present across the transistor. During switch-off, there is likewise approximately no voltage present across the transistor, since the resonance capacitor C1 is still discharged and the voltage across C1 or across the transistor Q1 only rises slowly as a result of the coil current. During the (sufficiently fast) switching process, the voltage across the switching transistor is still zero to a good approximation. Since no voltage is present across the transistor Q1 both when said transistor is switched on and when said transistor is switched off, no switching losses arise either. The theoretical power loss in Q1 is calculated as: $P_{Q1,loss}=U_{Q1}*I_{Q1}$. A resonance capacitance C1 in parallel with the transistor Q1 and an inductor L in series therewith are absolutely necessary, therefore, for ZVS.

In order to increase the efficiency of the circuit, the diode D2 can be supplemented by an arrangement for synchronous rectification. Thus, by way of example, the diode D2 can be replaced by a transistor, e.g. a MOSFET, with a corresponding drive circuit. As an alternative, the diode D2 can be replaced by a series circuit formed by at least two light emitting diodes.

Figure 4:
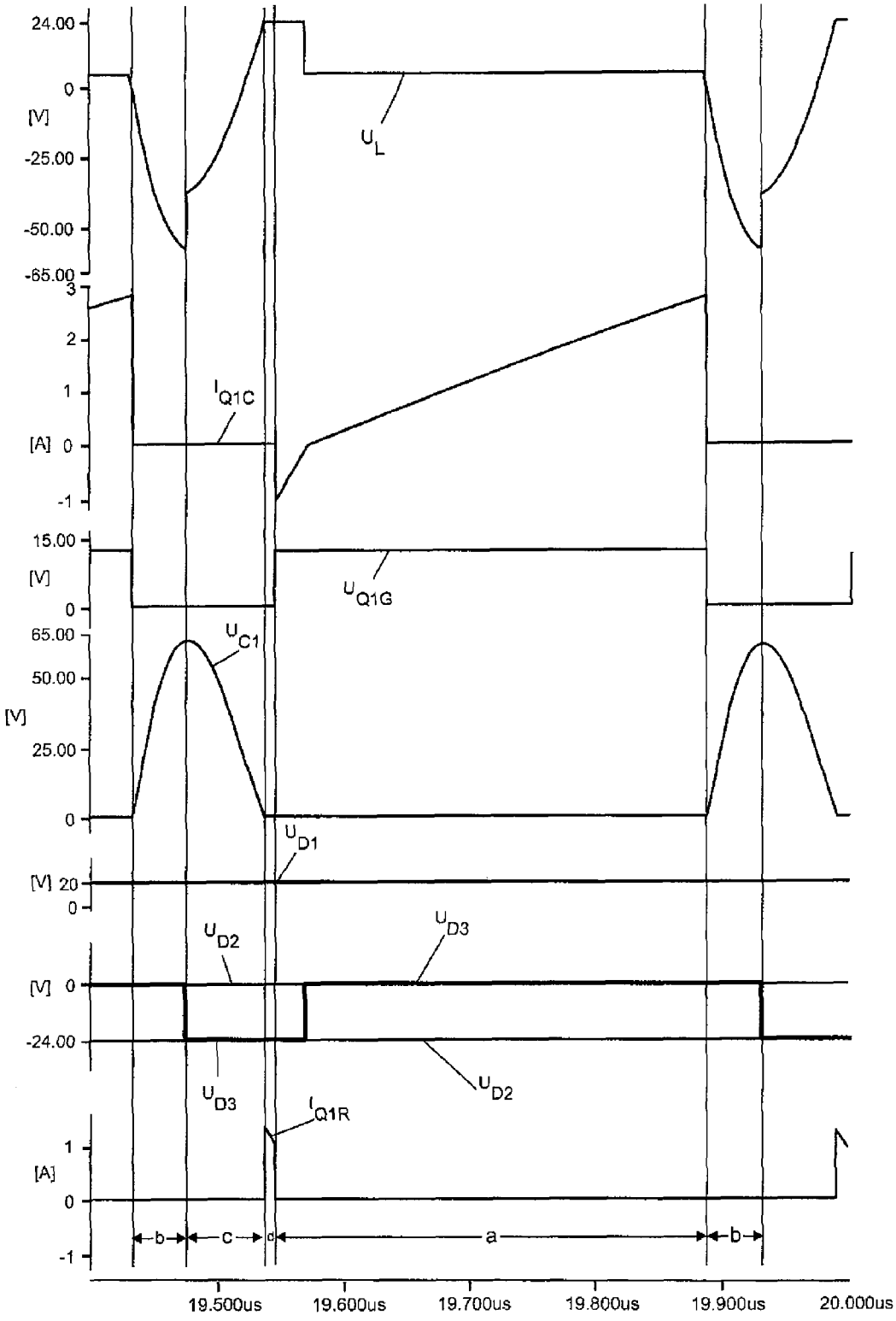
FIG. 4 shows some signals from the circuit arrangement from FIG. 3.

In contrast to the prior art, in the case of light emitting diode drivers, the power converted in the at least one light emitting diode D1 or the average current flowing through the load cannot be regulated by means of pulse width modulation, since otherwise the switching under ZVS operation could not be ensured. Instead of this, the switched-off duration $T_{off}$ of the switch, which results as the sum of the time ranges b to d in FIGS. 2 and 4, is kept constant and the switched-on duration, which corresponds to the time range a, is varied. The regulation has the converter frequency as a manipulated variable. An excessively low load current, i.e. an excessively small voltage drop across the measuring resistor $R_{shunt}$, leads to a reduction of the frequency, whereas an excessively high load current entails an increase in the frequency. What should be mentioned as particularly advantageous in the case of this concept, in comparison with other soft-switching converter concepts, is the circumstance that the switched-off duration $T_{off}$ is comparatively independent of the magnitude of the load, since the load behavior only influences the time range b. This enables the drive circuit to be constructed in a particularly simple manner.

If a precise regulation of the light emitting diode current is required, it is necessary to measure the current through the at least one light emitting diode D1, and the converter frequency is correspondingly varied by the regulation. The current measurement signal can be detected for example by a shunt in series with the light emitting diode (not illustrated). This measurement signal is subjected to low-pass filtering and fed to the regulation as an actual variable.

If a constant power is intended to be provided at the at least one light emitting diode D1, it is additionally necessary to measure the light emitting diode voltage. The multiplication of light emitting diode current and light emitting diode voltage or of the corresponding measurement signals that have not been subjected to low-pass filtering yields the instantaneous power, which, having been subjected to low-pass filtering, is fed to the regulation as an actual variable.

Particular emphasis should be given to the fact that the circuit would also function without the storage capacitor C2. However, the oscillating energy that is absolutely necessary for the ZVS would then be drawn via the measuring resistor $R_{shunt}$ from the feed line of the device from the voltage source $V_{in}$ and be fed back into the latter again. This would adversely affect the electromagnetic compatibility and also the efficiency of the light emitting diode driver. By virtue of the particular arrangement of the storage capacitor C2 in parallel with the series circuit formed by D1, L and Q1 in accordance with FIG. 1, the storage capacitor C2 takes up the ripple current. The use of an EMC filter, e.g. a low-pass filter, at the input of the circuit is additionally possible. This EMC filter supplies the circuit with a constant current. This arrangement of the storage capacitor C2 additionally has the advantage that the ripple current does not flow via the measuring resistor $R_{shunt}$ and, consequently, it is possible to dispense with a low-pass filtering of the measurement signal from the measuring resistor $R_{shunt}$. The measurement signal can be used directly for regulating the load power or the average light emitting diode current. The losses which would arise as a result of the pulsating current in the measuring resistor $R_{shunt}$ are additionally obviated.

The use of the voltage across the measuring resistor $R_{shunt}$ as a measurement variable for the regulation is particularly advantageous, since this signal—as already mentioned above—has no high-frequency ripple and additionally has reference to ground. As a result, the circuitry outlay is low since no "high-side measurement" is necessary.

In this first embodiment, the load, that is to say the at least one light emitting diode, is operated with a pulsating DC current. The diode D2 connected back-to-back has the effect in this case that the load current never reverses.

In one preferred embodiment that is not illustrated in the figures, in order to reduce the maximum rate of voltage change in the voltage present across the (switching) diode D2 connected back-to-back, a capacitor is connected in parallel with the diode D2. This additional capacitor, which is designated hereinafter as load-relieving capacitor, leads to a reduction of the maximum dU/dt occurring across the diode D2 and thus reduces the switching losses occurring in the diode D2. This is advantageous particularly when using PN diodes or PiN diodes composed of silicon for the diode D2. The load-relieving capacitor could additionally bring about a reduction of the switching losses possibly occurring in the at least one light emitting diode. The load-relieving capacitor should have a sufficiently high value in order to be able to bring about an appreciable reduction of the maximum rate of voltage change. On the other hand, the dimensioning of the load-relieving capacitor should not be made too high, since otherwise the requirements made of the switch Q1 increase significantly. This last concerns, in particular, the required switch reverse voltage and also the required switch current of Q1, which would lead to a generally more cost-intensive switch Q1. A good compromise lies in choosing the load-relieving capacitor in the range of between one hundredth of and fifty times the capacitance value of the capacitor C1, but preferably in the range of between one-twentieth of and twice the capacitance value of the capacitor C1.

Second Embodiment

Figure 3:
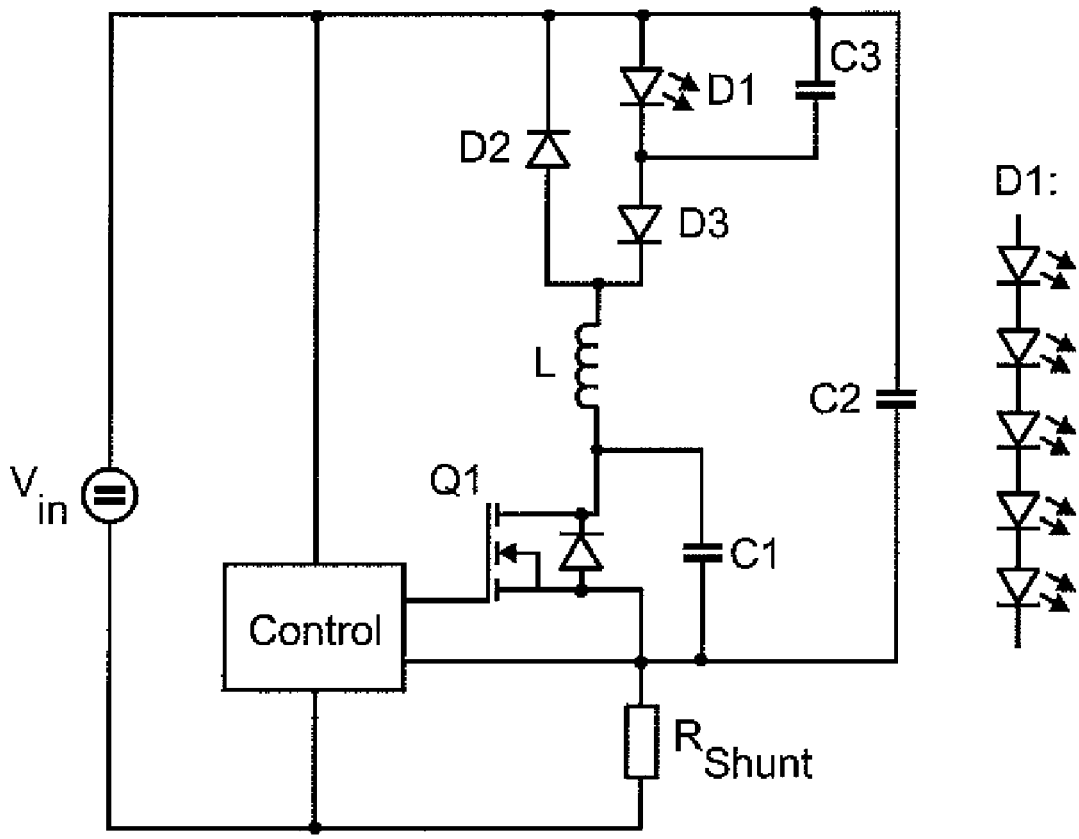
FIG. 3 shows a simplified circuit diagram of a circuit arrangement according to the invention in a second embodiment.

FIG. 3 shows a second embodiment of the circuit arrangement according to the invention. This has the advantage that now an approximately constant current flows through the at least one light emitting diode, as is illustrated in FIG. 4. Particularly if the at least one light emitting diode is intended to be operated in a manner remote from the rest of the circuit, simple compliance with the electromagnetic compatibility of the circuit can be ensured in the second embodiment. The approximately constant light emitting diode current becomes possible as a result of the additional smoothing by means of the second storage capacitor C3. However, it is now no longer possible to use the rectifying property of the at least one light emitting diode, and the additional diode D3 is necessary. The circuit in accordance with FIG. 3 is a DC voltage converter with ZVS which can be used, in principle, for any desired DC voltage loads. Simple compliance with the electromagnetic compatibility of the circuit can easily be ensured particularly when the additional storage capacitor C3 is situated close to the rest of the circuit.

The component dimensionings for the first and second embodiments are indicated in the table below. Exemplary embodiments #1 and #2 are different dimensionings of the first embodiment for different output powers. Exemplary embodiments #3 and #4 are dimensionings for the second embodiment. The exemplary embodiments are designed for five series-connected high-power light emitting diodes, e.g. Dragon light emitting diodes from Osram Opto-Semiconductors.

| | Exemplary embodiment | | | |
|---|---|---|---|---|
| | #1 | #2 | #3 | #4 |
| Dimensioning | | | | |
| L [nH] | 1500 | 500 | 500 | 4000 |
| C1 [nF] | 1.0 | 0.3 | 1.0 | 10 |
| C2 [nF] | 100 | 100 | 100 | 2200 |
| C3 [nF] | — | — | 100 | 2200 |
| D1 | 5 high-power light emitting diodes connected in series | | | |
| D2 | Fast diode (e.g. Schottky) | | | |
| D3 | — | — | Analogous to D2 | |
| $R_{shunt}$ | 10 mΩ | 10 mΩ | 10 mΩ | 10 mΩ |
| Q1 | N-channel power MOSFET | | | |
| Operating parameters | | | | |
| $U_{in}$ [V] | 24 | 24 | 24 | 24 |
| f [MHz] | 2.65 | 2.65 | 2.65 | 0.38 |
| D [%] | 50 | 85 | 75 | 65 |
| $P_{D1}$ [W] | 8.6 | 26.5 | 21.2 | 18.5 |

The input voltages are identical in each case. The different power arises on the basis of different operating frequencies, component dimensionings and also as a result of the duty cycle D. For a given component dimensioning, it is possible to set the power by varying the frequency within certain limits, wherein the duty cycle D is advantageously to be chosen such that ZVS operation of the switch Q1 is established.

In four further exemplary embodiments, #1a to #4a, rather than Schottky diodes, silicon PiN diodes are used for the diodes D2. All the other dimensionings correspond, however, to those for exemplary embodiments #1 to #4 in accordance with the table above. In order to reduce the maximum rate of voltage change in the diodes D2, load-relieving capacitors having one-tenth of the capacitance value of the capacitor C1, consequently having 100 pF, 30 pF, 100 pF and 1 nF, respectively, are in each case connected in parallel with the diode D2. In the exemplary embodiments #3a and #4a, this simultaneously leads to a likewise advantageous reduction of the maximum rate of voltage change in the diode D3.

The regulation in the case of a DC voltage converter application in which a constant output voltage is required would minimize deviations of the voltage of the second storage capacitor C3 from the predetermined desired value. However, the current through the at least one light emitting diode D1 could also be measured and be correspondingly regulated to said value.

Instead of effecting regulation to the actual light emitting diode power, regulation to the input power of the light emitting diode driver can take place in very many applications. By way of example, the measurement of the input voltage $V_{in}$ and of the input current, e.g. of the current through the measuring resistor $R_{shunt}$, and the input power determined therefrom then suffice in order to regulate the light emitting diode power sufficiently precisely, if appropriate taking account of the converter efficiency. Since there is no need for direct measurement on the light emitting diode, this leads to a particularly cost-effective driver. If an approximately constant input voltage $V_{in}$ can be assumed, moreover, the measurement of the input voltage can also be obviated. If the efficiency of the driver is known depending on e.g. the input voltage $U_{in}$ and the temperature, these can be stored in corresponding tables, e.g. in a microcontroller. These influencing variables can then be "worked out" by a microcontroller. Consequently, the desired value for the regulation is correspondingly adapted depending on the influencing variables and thus depending on the present efficiency of the circuit arrangement. The procedure described usually requires no additional hardware outlay at all, since said influencing variables are detected by the microcontroller anyway: the input voltage $U_{in}$ is detected anyway owing to the over- and undervoltage protection. The same situation prevails with the temperature of the light emitting diode, since said temperature is likewise to be detected anyway owing to the "derating", that is to say the reduction of the light emitting diode power or of the light emitting diode current in the case of overtemperature.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

I claim:

1. A circuit arrangement for operating at least one semiconductor light source having an input for inputting an input voltage, an output for outputting an output voltage to the semiconductor light source, wherein the main current path of the circuit arrangement lies between the two input terminals, and comprises a series circuit formed by a switch, an inductance and a back-to-back connection of a first diode or semiconductor light source and the at least one semiconductor light source, a first storage capacitor arranged in parallel with the at least one semiconductor light source, and a second diode arranged in series with this parallel connection.

2. The circuit arrangement as claimed in claim 1, wherein a resonance capacitor is arranged in parallel with the switch, the capacitance of said resonance capacitor being greater than the effectively active parasitic capacitance of the switch.

3. The circuit arrangement as claimed in claim 1, wherein the input voltage is greater than the output voltage, and the circuit arrangement clocks the switch for operating the at least one semiconductor light source with a high frequency.

4. The circuit arrangement as claimed in claim 3, wherein the clock frequency of the switch is greater than 80 kHz.

5. The circuit arrangement as claimed in claim 4, wherein the clock frequency of the switch is greater than 500 kHz.

6. The circuit arrangement as claimed in claim 1, wherein in the case of a plurality of semiconductor light sources, the latter are connected in series.

7. The circuit arrangement as claimed in claim 1, wherein a second storage capacitor is arranged in parallel with the main current path.

8. The circuit arrangement as claimed claim 1, wherein a current measuring resistor is additionally arranged in series with the main current path.

9. The circuit arrangement as claimed in claim 8, wherein one pole of the current measuring resistor is connected to ground, and the other pole of the current measuring resistor is connected to one pole of the first storage capacitor and to one pole of the switch.

10. The circuit arrangement as claimed in claim 1, wherein the switch is operated in the ZVS mode.

11. The circuit arrangement as claimed in claim 10, wherein the switch is operated with a constant switch-off time and a variable switch-on time.

12. The circuit arrangement as claimed in claim 1, wherein a load-relieving capacitor is provided.

13. The circuit arrangement as claimed in claim 1, wherein the circuit arrangement is configured for setting the power emitted to the at least one semiconductor light source by means of the frequency.

14. The circuit arrangement as claimed in claim 13, wherein the power emitted to the at least one semiconductor light source is higher at relatively low frequency and lower at relatively high frequency.

* * * * *